US009042796B2

(12) United States Patent
Robles Flores et al.

(10) Patent No.: US 9,042,796 B2
(45) Date of Patent: May 26, 2015

(54) TRANSFER ASSIST BLADE

(71) Applicant: Xerox Corporation, Norwalk, CT (US)

(72) Inventors: Eliud Robles Flores, Webster, NY (US); David J. Gervasi, Pittsford, NY (US); Michael S. Roetker, Webster, NY (US); Santokh S. Badesha, Pittsford, NY (US); Phillip J. Wantuck, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/016,502

(22) Filed: Sep. 3, 2013

(65) Prior Publication Data

US 2015/0063880 A1 Mar. 5, 2015

(51) Int. Cl.
*G03G 15/16* (2006.01)

(52) U.S. Cl.
CPC ..... *G03G 15/16* (2013.01)

(58) Field of Classification Search
CPC ..... G03G 15/16; G03G 15/0194; G03G 15/0163; G03G 15/1685; G03G 21/0011; G03G 21/0017
USPC ..... 399/66, 101, 297, 303, 314, 316, 317, 399/318
See application file for complete search history.

(56) References Cited

U.S. PATENT DOCUMENTS

| | | | | |
|---|---|---|---|---|
| 2,836,725 | A | 5/1958 | Vyverberg | |
| 4,341,456 | A | 7/1982 | Iyer et al. | |
| 5,568,238 | A | 10/1996 | Osbourne et al. | |
| 5,893,665 | A * | 4/1999 | Ichikawa et al. | 399/314 |
| 6,496,673 | B2 * | 12/2002 | Bessho | 399/175 |
| 8,594,553 | B2 * | 11/2013 | Uematsu et al. | 399/350 |
| 2002/0044800 | A1 * | 4/2002 | Kimura | 399/303 |
| 2011/0150514 | A1 * | 6/2011 | Falvo et al. | 399/66 |
| 2011/0249997 | A1 * | 10/2011 | Robles-Flores | 399/377 |
| 2013/0028642 | A1 * | 1/2013 | Yagi et al. | 399/313 |

* cited by examiner

*Primary Examiner* — Francis Gray
(74) *Attorney, Agent, or Firm* — Hoffman Warnick LLC

(57) ABSTRACT

There is described a transfer assist blade for an electrostatographic machine. The transfer assist blade includes a wear layer for contacting a copy sheet, an interior layer having a thickness of from about 150 microns to about 500 microns and a back layer comprising a thermoset polyimide having dispersed therein carbon particles such that an out surface of the back layer has a surface resistance of from about $1\times10^8$ ohms to about $9.99\times10^8$ ohms.

16 Claims, 3 Drawing Sheets

| E9 DECADE SAMPLING | |
|---|---|
| RESITIVITY | ACTION |
| $1.00 \times 10^9$ | HOLD |
| $2.49 \times 10^9$ | HOLD |
| $2.50 \times 10^9$ | HOLD |
| $4.99 \times 10^9$ | HOLD |
| $5.0 \times 10^9$ | SCRAP |
| $9.9 \times 10^9$ | SCRAP |

TRANSFER ASSIST BLADE

BACKGROUND

1. Field of Use

This disclosure is generally directed an apparatus for assisting transfer of a developed image to a copy substrate in an electrostatographic printing machine. The apparatus enhances physical contact between the copy substrate and the developed image, wherein the apparatus includes a conductive blade member for eliminating image defects.

2. Background

Generally, the process of electrostatographic copying is initiated by exposing a light image of an original document onto a substantially uniformly charged photoreceptive member. Exposing the light image onto the charged photoreceptive member discharges a photoconductive surface thereof in areas corresponding to non-image areas in the original document while maintaining the charge in image areas, thereby creating an electrostatic latent image of the original document on the photoreceptive member. Thereafter, developing material comprising charged toner particles is deposited onto the photoreceptive member such that the toner particles are attracted to the charged image areas on the photoconductive surface to develop the electrostatic latent image into a visible image. This developed image is then transferred from the photoreceptive member, either directly or after an intermediate transfer step, to an image support substrate such as a copy sheet, creating an image thereon corresponding to the original document. The transferred image is typically affixed to the image support substrate to form a permanent image thereon through a process called "fusing". In a final step, the photoconductive surface of the photoreceptive member is cleaned to remove any residual toner particles thereon in preparation for successive imaging cycles.

The electrostatographic copying process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

The process of transferring charged toner particles from an image bearing member, such as the photoreceptive member, to an image support substrate, such as the copy sheet is accomplished at a transfer station, wherein the transfer process is enabled by electrostatically overcoming adhesive forces holding the toner particles to the image bearing member. In a conventional electrostatographic machine, transfer is achieved by transporting the image support substrate into the area of the transfer station where electrostatic force fields sufficient to overcome the forces holding the toner particles to the photoconductive surface are applied to attract and transfer the toner particles over onto the image support substrate. In general, such electrostatic force fields are generated via electrostatic induction using a corona generating device, wherein the copy sheet is placed in direct contact with the developed toner image on the photoconductive surface while the reverse side of the copy sheet is exposed to a corona discharge. This corona discharge generates ions having a polarity opposite that of the toner particles, thereby electrostatically attracting and transferring the toner particles from the photoreceptive member to the image support substrate. An exemplary corotron ion emission transfer system is disclosed in U.S. Pat. No. 2,836,725.

During electrostatic transfer of a toner image to a copy sheet, it is generally necessary, or at least desirable, for the copy sheet to be in uniform intimate contact with the photoconductive surface and the toner powder image developed thereon. Unfortunately, however, the interface between the photoreceptive surface and the copy substrate is not always optimal. In particular, non-flat or uneven image support substrates, such as copy sheets that have been mishandled, left exposed to the environment or previously passed through a fixing operation (e.g., heat and/or pressure fusing) tend to promulgate imperfect contact with the photoreceptive surface of the photoconductor. Further, in the event the copy sheet is wrinkled, the sheet will not be in intimate contact with the photoconductive surface and spaces or air gaps will materialize between the developed image on the photoconductive surface and the copy sheet where there is a tendency for toner not to transfer across these gaps, causing variable transfer efficiency and, in extreme cases, creating areas of low or no transfer, resulting in a phenomenon known as image transfer deletion. Clearly, an image transfer deletion is very undesirable in that useful information and indicia are not reproduced on the copy sheet.

As described, the typical process of transferring development materials in an electrostatographic system involves the physical detachment and transfer-over of charged toner particles from an image bearing photoreceptive surface into attachment with an image support substrate via electrostatic force fields. Thus, a very critical aspect of the transfer process is focused on the application and maintenance of high intensity electrostatic fields in the transfer region for overcoming the adhesive forces acting on the toner particles as they rest on the photoreceptive member. Another critical aspect of the transfer process is focused on the application of mechanical force on the copy sheet in the transfer region for overcoming the adhesive forces acting on the toner particles as they rest on the photoreceptive member.

It would be desirable to provide a transfer assist device that meets the mechanical and electrical needs for transferring toner particles from the photoreceptive member to the copy sheet.

SUMMARY

Disclosed herein is an apparatus for transferring a developed image from an image bearing surface to a copy sheet. The apparatus includes a charging station for charging the copy sheet to attract the developed image from the image bearing surface to the copy sheet. The apparatus includes a transfer assist blade for pressing the copy sheet into contact with the developed image on the image bearing surface in a region proximate to the charging station for substantially eliminating any spaces between the copy sheet and the developed image. The transfer assist blade is shifted between a non-operative position spaced from the image bearing surface, and an operative position in contact with the copy sheet on the image bearing surface. The transfer assist blade includes a wear layer for contacting the copy sheet, an interior layer and a back layer including a thermoset polyimide having dispersed therein carbon particles such that an outer surface of the back layer has a surface resistance of from about $1\times10^8$ ohms to about $9.99\times10^8$ ohms. The apparatus includes a lever member for shifting the transfer assist blade between the non-operative position and the operative positions in response to a registration signal.

There is described a transfer assist blade for an electrostatographic machine. The transfer assist blade includes a wear layer for contacting a copy sheet, an interior layer having a thickness of from about 150 microns to about 500 microns and a back layer comprising a thermoset polyimide having dispersed therein carbon particles such that an out surface of the back layer has a surface resistance of from about $1\times10^8$ ohms to about $9.99\times10^8$ ohms.

Disclosed herein is an electrostatographic printing machine of the type in which a developed image is transferred from a photoconductive surface to a copy sheet at a transfer station. The machine includes an electrostatic charging unit for charging the copy sheet to attract the developed image from the photoconductive surface to the copy sheet. The machine includes a transfer assist blade for pressing the copy sheet into contact with at least the developed image on the photoconductive surface. The transfer assist blade includes a wear layer for contacting the copy sheet, an interior layer having a thickness of from about 150 microns to about 500 microns and a back layer. The back layer includes a thermoset polyimide having carbon particles dispersed therein such that an outer surface of the back layer has a surface resistance of from about $1\times10^8$ ohms to about $9.99\times10^8$ ohms. The transfer assist blade is adapted to be shifted between a non-operative position spaced from the photoconductive surface, and an operative position in contact with the copy sheet on the photoconductive surface. A lever member shifts the transfer assist blade between the non-operative position and the operative position in response to a registration signal.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1:
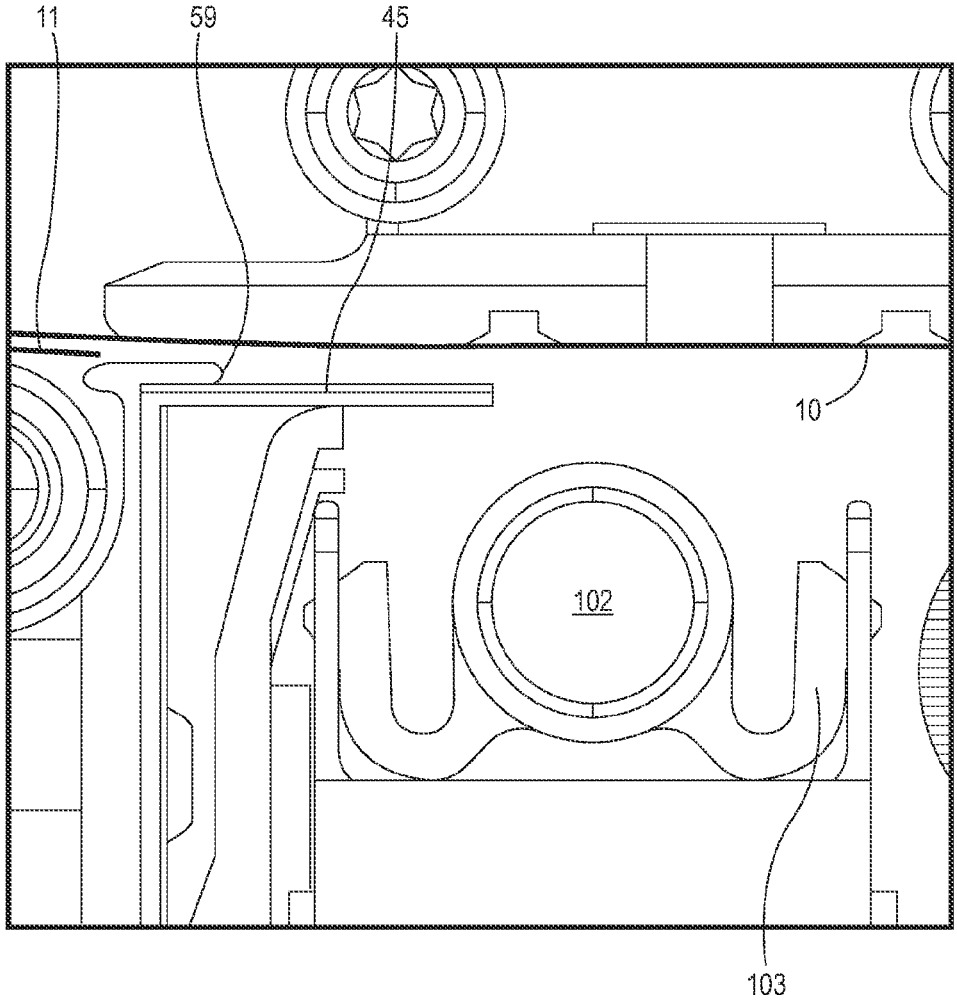
FIG. 1 is sectional side view showing a transfer assist blade disclosed herein and its use in an electrostatographic printing machine to press a copy sheet against a developed image on a photoconductive surface.

With specific reference to FIG. 1, the transfer assist apparatus is depicted in a sectional view to more clearly reveal the various components included therein. As shown in FIG. 1, a copy substrate 11, (also referred to as a copy sheet or a print substrate) is fed toward photoconductive belt 10. A charging station includes a corona generating device 102, which can include a generally U-shaped shield, indicated generally by the reference numeral 103. The corona generating device 102 charges the copy sheet 11 at the transfer station to attract the toner powder image from the photoconductive belt 10 to the copy sheet 11. The corona generating device 102 is spaced from the image bearing surface of the photoconductive belt 10 to define a gap therebetween through which the copy sheet passes. One skilled in the art will appreciate that any suitable corona generating device may be employed, as for example, a corona generator having an electrode which is comprised of spaced pins or a wire and a shield which may be limited to a pair of side walls having no back wall.

The transfer assist blade 45 presses the copy sheet into intimate contact with the toner powder image on photoconductive belt 10. The transfer assist blade 45 continuously exerts a force toward photoconductive belt 10. This force is opposed by the end of lever arm 59 for holding the blade 45 away from the surface of the photoreceptor 10.

A lever arm 59 or lever member is mounted adjacent to transfer assist blade 45, having a free end which contacts blade 45 along the protruding segment thereof. In an embodiment, the opposite end of lever arm 59 is secured via pivot arm to a solenoid (not shown). Lever arm 59 is adapted to be pivoted about a pivot point along a central portion where actuation of the solenoid pivots the lever arm 59 permitting blade the transfer assist blade 45 to flex or pivot toward the surface of the photoreceptor 10 and into an operative position against the back of the copy sheet 11. Conversely, when the solenoid is de-energized or de-actuated, the transfer assist blade 45 is be deflected away from the surface of the photoreceptor 10, to a non-operative position. It will further be appreciated that the transfer assist blade 45 described herein may be advantageously shifted between the operative and non-operative positions by some mechanism other than a solenoid, such as a stepper motor, a rotary solenoid, etc.

As transfer assist blade 45 moves from the non-operative position to the operative position, the free end of blade 45 contacts the back of the copy sheet 11 and presses the copy sheet 11 against the developed toner powder image on photoconductive belt 10. This substantially eliminates any spaces between the copy sheet and the toner powder image, thereby enhancing the transfer of the toner powder image to the copy sheet 11 such that the toner powder image transferred to the copy sheet is substantially deletion free. After transfer is completed, a light sensor (not shown) detects the trailing edge of the copy sheet 11, and, after a suitable delay, the controller transmits a de-energizing signal to the solenoid and moving transfer assist blade 45 it from the operative position to the non-operative position, away from the surface of the photoreceptor 10. Thus, as the copy sheet 11 passes out of the transfer station so that the transfer assist blade 45 does not come in direct contact with the photoconductive surface.

The precise timing of the entrance of a copy sheet 11 is determined by a registration synchronization signal, which is processed by a circuit for controlling the actuation of transfer assist blade 45. Transfer assist blade 45 is moved from a non-operative position, spaced from the copy sheet and the photoconductive belt 10 to an operative position in contact with the back side of the copy sheet. A mechanical transport mechanism such as a solenoid, described previously, moves transfer assist blade 45 between the operative and non-operative positions. In the operative position, blade 45 presses the copy sheet into contact with the toner powder image developed on photoconductive belt 10 for substantially eliminating any spaces between the copy sheet and the toner powder image such that the continuous pressing of the sheet into contact with the toner powder image at the transfer station insures that the copy sheet is in substantially intimate contact with the belt 10. As the trailing edge of the copy sheet passes a light sensor (not shown), the light sensor transmits a registration synchronization signal to a processing circuit which de-energizes the solenoid for shifting the blade 45 to its non-operative position. In the non-operative position, blade 45 is spaced from the copy sheet and the photoconductive belt, insuring that blade 45 does not scratch the photoconductive belt or accumulate toner particles thereon which may be deposited on the backside of the next successive copy sheet. An exemplary type of light sensor and delay circuit is described in U.S. Pat. No. 4,341,456, which is hereby incorporated by reference in its entirety.

Figure 2:
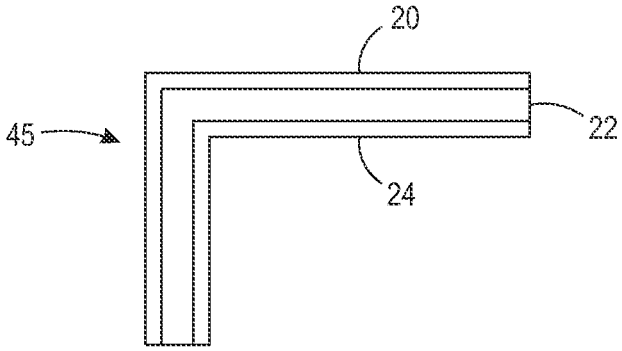
FIG. 2 is a sectional view of the transfer assist blade described herein.

Turning now to FIG. 2, a transfer assist blade 45 is shown in greater detail. The transfer assist blade 45 must be able to deflect. The transfer assist blade 45 deflects about 3 mm under a 3 gram load (based on a specific setup we have in the lab). The measurement is done in a cantilever-like setup, where the transfer assist blade sample is placed on an edge, loaded at the tip with a force gauge, and deflection is measured on a scale in the back. The total thickness of the transfer assist blade is from about 350 microns to about 900 microns. The transfer assist blade 45 includes a wear layer 20 which contacts the copy sheet 11 during operation. The wear layer 20 has a thickness of from about 100 microns to about 200 microns or in embodiments from about 110 microns to about 190 microns or from about 120 microns to about 180 microns. The wear layer 20 is composed of an ultra high molecular weight polymer such as 5425 UHMW polyethylene film with acrylic based pressure sensitive adhesive on one side, available from 3M. The wear layer 20 is insulating and has a surface resistance greater than about $10^{10}$ ohms.

The transfer assist blade 45 includes one or more interior layers composed of polyester, such as Mylar®. The total thickness of interior layer 22 is from about 150 microns to about 500 microns or in embodiments from about 180 microns to about 450 microns or from about 200 microns to about 400 microns. In embodiments, 1 to 5 layers of material are used for the interior layer.

The transfer assist blade 45 includes a back layer 24. The back layer 24 or layer has a thickness of from about 50 microns to about 200 microns or in embodiments from about 75 microns to about 180 microns or from about 80 microns to about 180 microns. The back layer 24 is requires a surface resistance of between about $1\times10^8$ ohms to about $9.99\times10^8$ ohms. The range of surface resistance is required to allow adhesion between the interior layer and the back layer and to prevent contamination from dirt or toner particles. Without the back layer having the required resistance, dirt accumulates and transfers to the copy substrate causing undesired print artifacts. Also, the surface resistance of the back layer is required to tailor the corona field at the very tip of the blade and prevent high voltage breakdown which can causes undesired print artifacts.

The back layer 24 is made from a thermoset polyimide having carbon particles dispersed therein. The carbon particles provide conductivity and allow the surface resistance to meet the $1\times10^8$ ohms to about $9.99\times10^8$ ohms requirement.

The wear layer 20, interior layer 22 and the back layer 24 are bonded together with an adhesive.

Specific embodiments will now be described in detail. These examples are intended to be illustrative, and not limited to the materials, conditions, or process parameters set forth in these embodiments. All parts are percentages by solid weight unless otherwise indicated.

EXAMPLES

Figure 3:
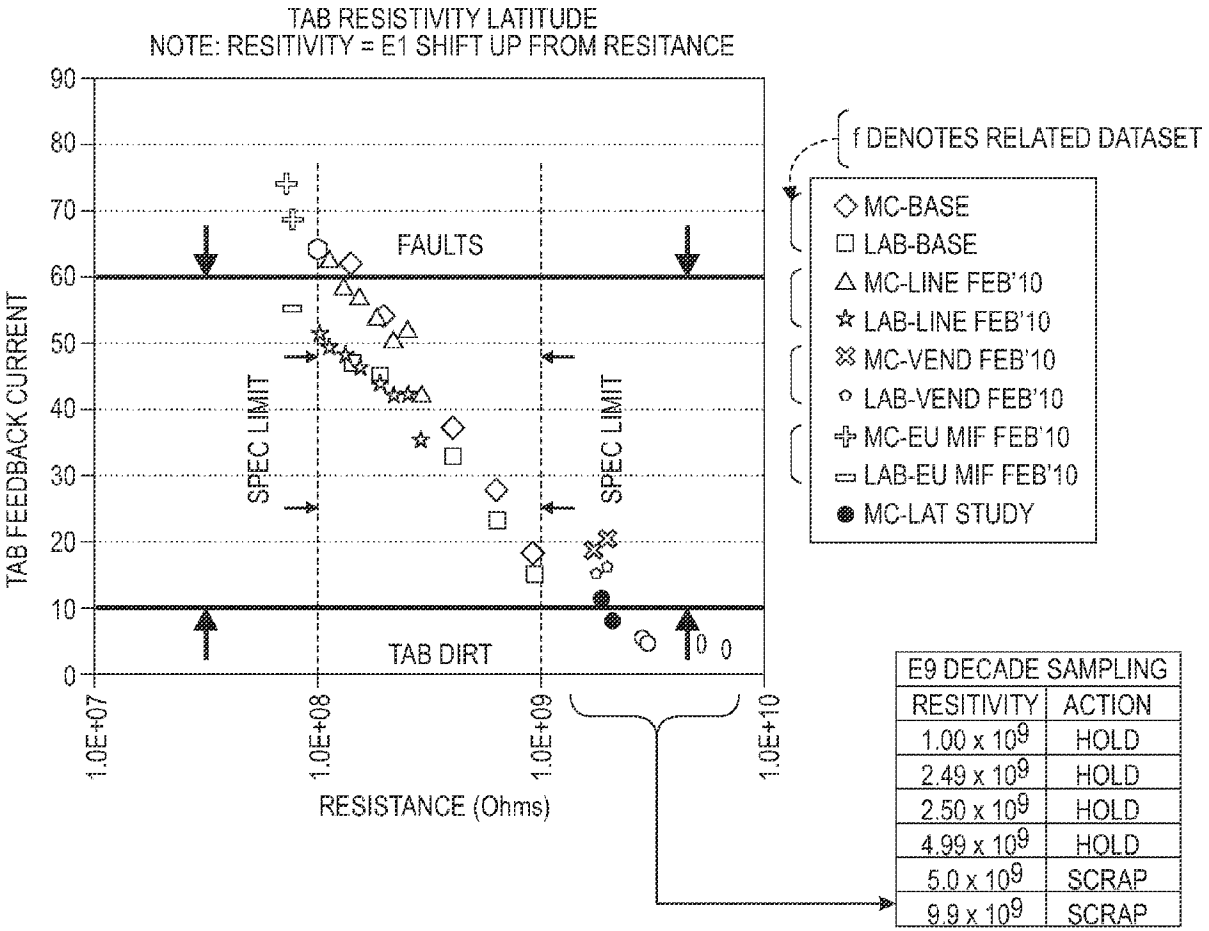
FIG. 3 show the latitude limits of the surface resistance for the back layer of the transfer assist blade described herein.

Shown in FIG. 3 is a graph transfer assist blade resistivity latitude table that shows the specification limits of the back layer resistivity. In this latitude there are two key boundaries: dirt (and breakdown) and faults. The first induces print artifacts when enough dirt accumulated on the blade or the blade charges up too high due to high resistance. The second produces a machine shutdown. None of these conditions are desirable.

The specification latitude was determined as shown in FIG. 3. A transfer assist blade was manufactured using the thermoset polyimide with dispersed carbon black as the back layer. Improved performance was validated through testing.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. An apparatus for transferring a developed image from an image bearing surface to a copy sheet, including, the apparatus comprising:

a charging station for charging the copy sheet to attract the developed image from the image bearing surface to the copy sheet wherein said charging station includes a corona generating device spaced from the image bearing surface to define a gap therebetween through which the copy sheet passes; a transfer assist blade for pressing the copy sheet into contact with the developed image on the image bearing surface in a region proximate to the charging station, wherein the transfer assist blade is shifted between a non-operative position spaced from the image bearing surface, and an operative position in contact with the copy sheet on the image bearing surface, wherein the transfer assist blade comprises in sequence:

a wear layer for contacting the copy sheet, wherein the wear layer of the transfer assist blade has a surface resistance of greater than about $10^{10}$ ohms;

an interior layer; and a back layer comprising a thermoset polyimide having dispersed therein carbon particles such that an outer surface of the back layer has a surface resistance of from about $1\times10^{8}$ ohms to about $9.99\times10^{8}$ ohms; and a lever member for shifting the transfer assist blade between the non-operative position and the operative positions responsive to a registration signal.

2. The apparatus of claim 1, wherein the wear layer of the transfer assist blade has a thickness from about 100 microns to about 200 microns.

3. The apparatus of claim 1, wherein the interior layer has a thickness from about 150 microns to about 500 microns.

4. The apparatus of claim 1, wherein the back layer has a thickness from about 50 microns to about 200 microns.

5. The apparatus of claim 1, wherein the interior layer of the transfer assist blade comprises polyester.

6. The apparatus of claim 1, wherein the wear layer of the transfer assist blade comprises an ultra high molecular weight polymer.

7. The apparatus of claim 1, wherein the transfer assist blade has a deflection of about 3 mm under a 3 gram load.

8. A transfer assist blade for an electrostatographic machine, the electrostatographic machine comprising a charging station for charging a copy sheet to attract a developed image from an image bearing surface to a copy sheet wherein said charging station includes a corona generating device spaced from the image bearing surface to define a gap therebetween through which the copy sheet passes;

the transfer assist blade comprising:

a wear layer for contacting a copy sheet, wherein the wear layer of the transfer assist blade has a surface resistance of greater than about $10^{10}$ ohms;

an interior layer having a thickness of from about 150 microns to about 500 microns; and a back layer comprising a thermoset polyimide having dispersed therein carbon particles such that an outer surface of the back layer has a surface resistance of from about $1\times10^{8}$ ohms to about $9.99\times10^{8}$ ohms.

9. The transfer assist blade of claim 8 comprising a thickness between about 400 microns and about 900 microns.

10. The transfer assist blade of claim 8, wherein the back layer has a thickness from about 50 microns to about 200 microns.

11. The apparatus of claim 8, wherein the transfer assist blade has a deflection of about 3 mm under a 3 gram load.

12. An electrostatographic printing machine of the type in which a developed image is transferred from a photoconductive surface to a copy sheet at a transfer station, comprising:

an electrostatic charging unit for charging the copy sheet to attract the developed image from the photoconductive surface toward the copy sheet wherein said electrostatic charging unit includes a corona generating device spaced from the photoconductive surface to define a gap therebetween through which the copy sheet passes;

a transfer assist blade for pressing the copy sheet into contact with at least the developed image on the photoconductive surface wherein the transfer assist blade includes a wear layer for contacting the copy sheet, wherein the wear layer of the transfer assist blade has a surface resistance of greater than about $10^{10}$ ohms, an interior layer having a thickness of from about 150 microns to about 500 microns; and a back layer comprising a thermoset polyimide having dispersed therein carbon particles such that an out surface of the back layer has a surface resistance of from about $1\times10^{8}$ ohms to about $9.99\times10^{8}$ ohms;

the transfer assist blade adapted to be shifted between a non-operative position spaced from the photoconductive surface, and an operative position in contact with the copy sheet on the photoconductive surface; and a lever member for shifting the transfer assist blade between the non-operative position and the operative positions, the lever member responsive to a registration signal.

13. The electrostatographic printing machine of claim 12, wherein the wear layer of the transfer assist blade has a thickness from about 100 microns to about 200 microns.

14. The electrostatographic printing machine of claim 12, wherein the interior layer has a thickness from about 150 microns to about 500 microns.

15. The electrostatographic printing machine of claim 12, wherein the back layer has a thickness from about 50 microns to about 200 microns.

16. The electrostatographic printing machine of claim 12, wherein the thermoset polymer comprises polyimide.

* * * * *